United States Patent [19]

Goller et al.

[11] Patent Number: 4,787,217

[45] Date of Patent: Nov. 29, 1988

[54] CAM CARRIAGE FOR FLAT-BED KNITTING MACHINE

[75] Inventors: Ernst Goller, Reutlingen; Jürgen Ploppa, Pfullingen; Franz Schmid, Bodelshausen; Hans-Günther Haltenhof, Pfullingen all of Fed. Rep. of Germany

[73] Assignee: H. Stoll GmbH & Co., Fed. Rep. of Germany

[21] Appl. No.: 92,522

[22] Filed: Sep. 3, 1987

[30] Foreign Application Priority Data

Sep. 4, 1986 [DE] Fed. Rep. of Germany ..... 3630050

[51] Int. Cl.[4] ..... D04B 7/10

[52] U.S. Cl. ..... 66/71; 66/78

[58] Field of Search ..... 66/71, 78

[56] References Cited

U.S. PATENT DOCUMENTS

| | | | |
|---|---|---|---|
| 4,502,300 | 3/1985 | Schimko | 66/71 |
| 4,510,775 | 4/1985 | Shima | 66/78 |
| 4,526,017 | 7/1985 | Shima | 66/71 |
| 4,554,802 | 11/1985 | Goller et al. | 66/71 |
| 4,686,838 | 8/1982 | Stoppazzini | 60/71 |
| 4,723,423 | 2/1988 | Goller et al. | 66/71 |

*Primary Examiner*—Ronald Feldbaum

*Attorney, Agent, or Firm*—Jones, Tullar & Cooper

[57] ABSTRACT

A cam carriage for flat-bed knitting machines has at least one leading and trailing draw-down element, having a drive top plate and a bottom plate with a draw-down track located at opposite sides of a cam plate in which a draw-down element is placed movably between an alignment position and several casting-off positions in a guide slot, and the driven top plate is rigidly connected with a drive element at least in the direction of the draw-down position. In such a cam carriage for flat-bed knitting machines, the draw-down elements of which provide a very high draw-down force on the one hand, and, on the other, react with sufficient resilience during the movement in the direction of the draw-down position, it has been provided that the top plate and the bottom plate, of the draw-down element are movable in relation to each other and are biased to take up a basic position such that a relative movement of the top and bottom plates can only be performed during a shifting movement of the top plate in the direction of one of the draw-down positions.

15 Claims, 3 Drawing Sheets

CAM CARRIAGE FOR FLAT-BED KNITTING MACHINE

FIELD OF THE INVENTION

The present invention relates to a cam carriage for flat-bed knitting machines with at least one leading and trailing draw-down element. The cam carriage has a driven top plate and a bottom plate with a draw-down track located at opposite sides of a cam plate in which a draw-down element is placed movably between an alignment position, i.e., a position where the head of the needle is in alignment with the knock-over edge of the comb, and several draw-down positions in a guide slot. The driven top plate is rigidly connected with a drive element at least in the direction of the draw-down position.

BACKGROUND OF THE INVENTION

Such cam carriages are known from, for example, applicants' unpublished patent application (P 36 30 051.9) and from German Laid-open Application DE-OS No. 32 45 230 (U.S. Pat. No. 4,502,300). In both cases the bottom plate is rigidly connected with the top plate; in the first case the top plate is moved back and forth by a driven link plate via a link roller engaging the cam of a link plate, while in the other case the top plate of the draw-down element is moved in the direction of draw-down by a gear rack against the effect of a draw spring. This rigid connection between the respective operational element and the draw-down element has, besides the advantage of a restraint and of sufficient force application in the course of shifting of the takeoff element into one of the draw-down positions, the disadvantage that shifting during lifting of the cam carriage can lead to malfunctions if, for example, one of the needles is sluggish or if, because of the knots and/or enlargements in the knitted fabric, the correct drawing movement of particular needles is not possible, or if the yarn is overstressed by extreme pulling. This can result in breakage of the needles and/or the yarn or in overloading of the step motor for the draw-down element(s). A further disadvantage results from the fact that during shifting of the draw-down position the transition from a tight to a loose loop is too abrupt, which has an adverse effect on the appearance of the knitted fabric and which possibly can also lead to breaks in the yarn.

On the other hand, a cam carriage is known from German Patent DE-PS No. 33 10 671 (U.S. Pat. No. 4,554,802) and from German Laid-open Application DE-OS No. 30 50 591 (U.S. Pat. No. 4,510,775) in which the draw-down element also consists of rigidly connected top and bottom plates. However, the casting-off element is biased by a tension spring in the draw-down direction which pulls the draw-down element against a respective drive element in the respective draw-down position. However, this had the disadvantage that in the respective draw-down position the force of the tension spring pulling the draw-down element into this position is at its weakest and this results in a draw-down force which does not satisfy the requirements. In other words, the draw-down force in the selected draw-down position can be so slight that individual needles change their selected draw-down position in an upward direction. However, an increase in the draw-down force exerted by the tension spring is not possible because of the corresponding force increase when moving the draw-down element into the alignment position.

SUMMARY OF THE INVENTION

It is therefore an object of the present invention to provide a cam carriage of the type described above, the casting-off elements of which provide a very high draw-down force but react with sufficient resiliency when moved in the direction of the draw-down position.

To attain this object a cam carriage for flat-bed knitting machines of the type described above is proposed having the top plate and the bottom plate of the draw-down element movable in the longitudinal direction thereof in relation to each other and biased to take up a basic position such that the relative movement of the top and bottom plates can only occur during a shifting movement of the top plate in the direction of the draw-down positions.

In accordance with the present invention it is possible, in spite of the rigid drive connection between the drive element and the top plate of the draw-down element, to have the bottom plate with the draw-down track react with elastic resiliency to sluggish needles, knots and enlargements in the knitted material and the like. This is done in that, when encountering such an obstacle, the bottom plate at first makes a slower movement than the forcibly driven top plate, however, the bottom plate can be made to follow because of the biased connection with the top plate. On the other hand, this increases reliability since possible needle or yarn breaks are thereby rendered impossible and, on the other hand, a smooth transition from a tighter to a looser loop when a draw-down position is changed during the lifting of the carriage is made possible. This is advantageous because it protects the yarn and especially the appearance of the respective knitted product. Additionally, overloading the motor because of an otherwise possible sluggishness of the draw-down element is avoided. At the same time a shifting of the casting-off element in the customary way during normal operation with the appearance of a relative movement between the top and bottom plates remains assured. This means that, for example, the shifting of the draw-down elements during carriage lift reversal can generally take place without force having to be applied since in these instances, there is practically no stress on the spring. This can be used to make the drive motor turn faster during the carriage lift reversal, because of the lesser required torque than is possible during carriage lift with needle load and the higher torque thus required. This allows a shortening of the lift reversal time.

In a preferred embodiment the bottom plate is pushed against a stop on the top plate by the action of at least one spring. With this relative movement between the bottom and top plates a relatively simple construction is achieved.

In connection with the customary rigid connection between the bottom and top plates it is necessary to perform an exact position of the draw-down element in the alignment position by means of mechanical readjustment. This is avoided by having the stop of the top plate adjustable in the longitudinal direction of the draw-down element. This adjustment or setting of the draw-down element in the alignment position becomes possible by a simple shifting of the draw-down element stop. This adjustment movement is performed in a practical way by means of a structurally simple construction according to which the stop is formed by a threaded element which can be screwed into the top plate in the longitudinal direction and locked.

The spring pushing the bottom plate against the stop of the top plate must be selected depending on the size of the needle gauge and the draw-down force required. It therefore can become necessary to provide two parallel springs in the case of a large needle gauge. However, independently thereof the spring can be a compression spring or a tension spring; in the former case this results in a very compact construction. It may be practicable to have the biasing of the spring adjustable which can, for example, be achieved in compression springs by having one end of the compression spring contained in a bore of the top plate and putting on an adjusting screw.

An exact guidance of the bottom and top plates and a problem-free adjustment of the alignment position and the spring force are the result of having the bottom plate provided with preferably two guide blocks which are contained in recesses of the top plate, the spring acting on one of the guide blocks while the other guide block abuts the stop in the basic position.

By having the guide blocks connected with the bottom plate via a guide strip by means of which the draw-down element is movably guided in the guide slot of the cam plate a mechanically simple construction of the draw-down element is achieved by having the guide blocks, the guide strip and the bottom plate fastened by screws. A simple manufacture of the several parts of the draw-down element is assured, while a reduction in the number of parts is achieved by having the guide blocks, the guide strip and the bottom plate made of one piece, and in that the recesses in the top plate are connected with one insertion opening each.

Further details of the invention are to be found in the description as follows, in which the invention is described and explained in detail by means of the exemplary embodiments shown in the drawings.

DETAILED DESCRIPTION OF THE PREFERRED EMBODIMENTS

Figure 1:
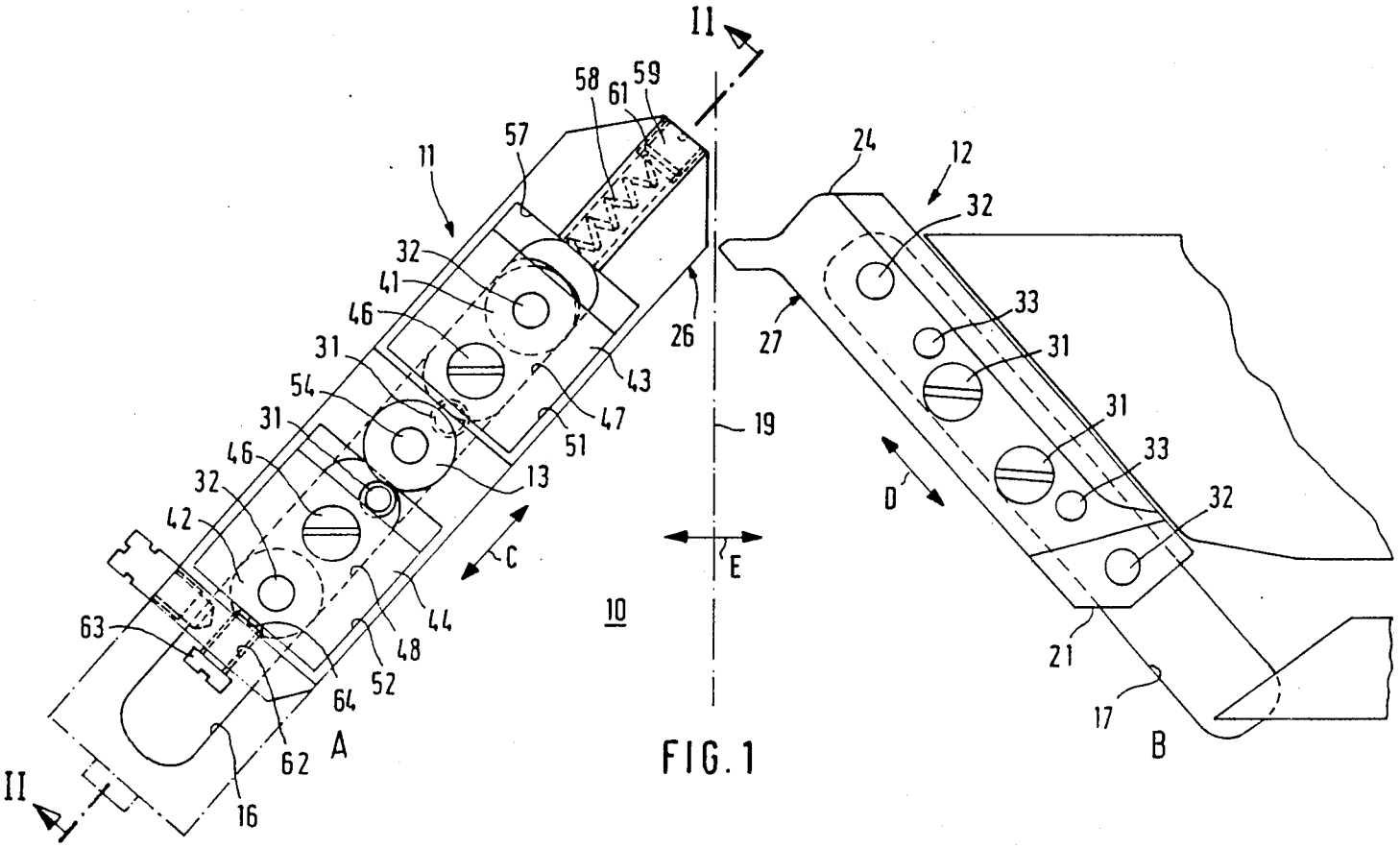
FIGS. 1A, B are schematic views of the position of a leading and trailing draw-down element which are in the alignment position on a cam carriage partial FIG. 1A being the top plan view of one draw-down element and partial FIG. 1B being a bottom view of the other draw-down element.
Figure 2:
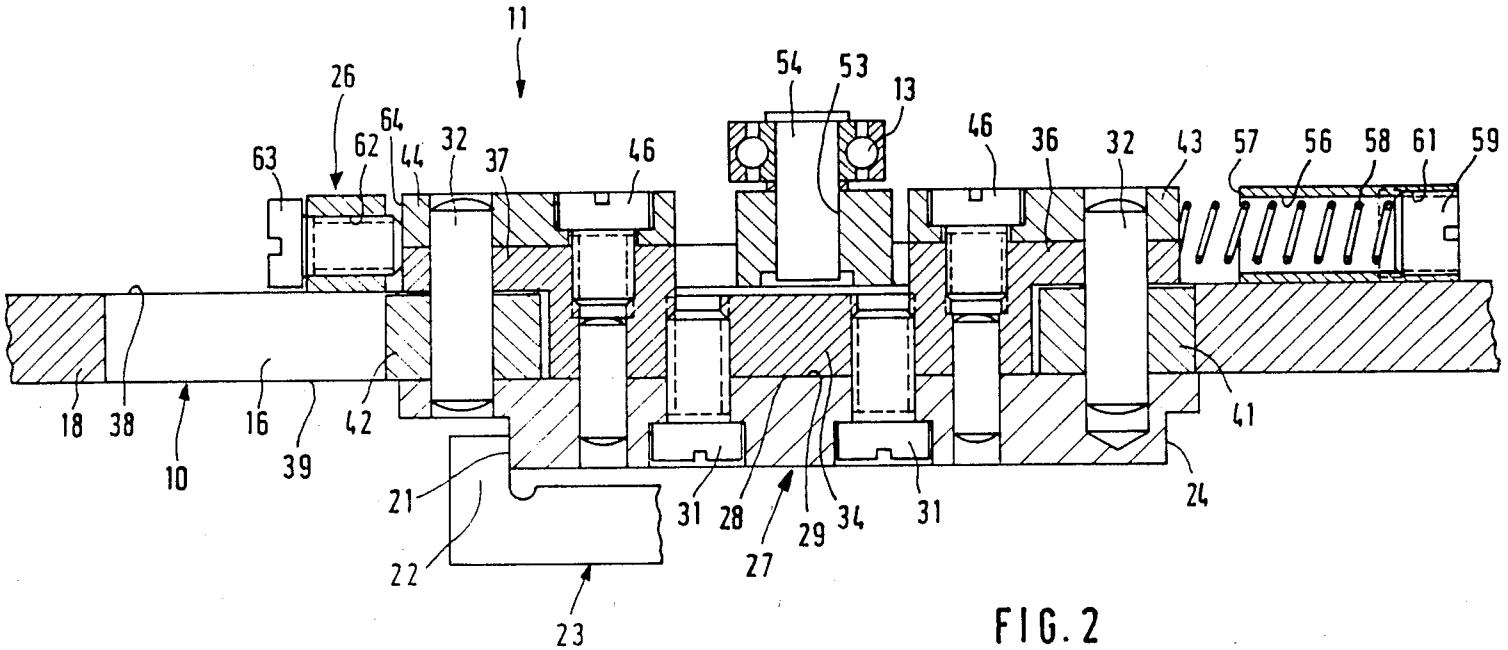
FIG. 2 is a section along the line II—II of partial FIG. 1A.

Two draw-down elements 11 and 12, oriented toward each other in the shape of a letter V, of a cam carriage 10 of a flat-bed knitting machine are shown in FIGS. 1 and 2, one of which, depending on the lifting direction of the cam carriage 10, is the draw-down part being in or set at the alignment position, the other the trailing draw-down element being in or set at one of a plurality of draw-down positions and also being capable of being adjusted during the carriage lift. The opposed position of the draw-down elements 11, 12 in the directions according to the double arrows C and D is accomplished in a form-fitting manner not shown in detail via a link roller 13 on each of the draw-down elements 11, 12. Both link rollers 13 engage a cam having a V-shaped basic form with a central and two lateral horizontal branches, and is provided on a link plate horizontally movable back and forth in the direction of the double arrow E by, for example, a step motor, as can be seen from applicants previously noted unpublished patent application. The draw-down elements 11 and 12 are maintained and guided in correspondingly V-shaped guide slots 16 and 17 in a cam plate 18 of the cam carriage 10 for the back and forth movement according to double arrows C and D.

Since both draw-down elements 11 and 12 have essentially identical construction it suffices to describe one of the draw-down elements 11 or 12. The only exception is that in the draw-down elements 11 and 12, disposed in the form of a letter V symmetrically to a center line 19, the respective draw-down tracks 21 for the butts 22 of knitting needles 23 and the respective work tracks 24 are arranged mirror-reversed with respect to the symmetry line 19.

Each draw-down element 11, 12 has a top plate 26 on the upper side 38 of the cam plate 18 and a bottom plate 27 on the opposite lower side 39 of the cam plate 18. The plates 26 and 27 are movable in the direction of the double arrow C or D in relation to the cam plate 18 and in relation to each other. The bottom plate 27 having the needle butt tracks 21 and 24, is connected by screws 31 with a guide strip 28 abutting its upper side 29 and fixed in place by means of set pins 32 and 33. The guide strip 28 is of width corresponding to the width of the guide slot 16 or 17 of the cam plate 18. The guide strip 28 is seated in the guide slot 16 or 17 with the central section 34 of its approximately trough-shaped profile and has upwardly displaced overhanging ends 36 and 37, the underside of which is disposed at the height of the upper side 38 of the cam plate 18. Each of these ends 36, 37 is connected via the set pins 32 with an annular sliding body 41 or 42, such sliding bodies 41, 42 fittingly embedded in the guide slot 16 or 17 and by means of which the draw-down element 11, 12 slides in the guide slot 16, 17 and is laterally guided. On the upper side of the ends 36 and 37 of the guide strip 28 are sliding blocks 43 and 44, which are screwed to ends 36 and 37 by screws 46, and are fixed in place by means of the set pins 32. These sliding blocks 43 and 44 have the same length as the ends 36 and 37, but are wider.

The top plate 26 which rests on the upper side 38 of the cam plate is approximately of an elongated rectangular shape and has on two long sides approximately rectangular inner recesses 47 and 48 in which the ends 36 or 37 of the guide strip 28 are contained. The width of the recesses 47 and 48 approximately corresponds to that of the ends 36 and 37, but the recesses 47 and 48 are longer than the ends 36 and 37. These inner recesses 47 and 48 lead into outer recesses 61 or 52 which have the same length as the inner recesses 47 and 48, but are wider so that they can contain the plate-shaped sliding blocks 43 and 44. In this manner the bottom plate 27 is guided by means of the ends 36 and 37 and the sliding blocks 43 and 44 in the recesses 47, 48 and 51, 52 in the direction of the double arrows C and D and is secured against disengagement in a direction vertically thereto by means of the sliding blocks 43 and 44. In addition, the top plate 26 has a bore 53 in its central part, in which the link roller 13 is secured via a fastening pin 54.

At that end of the top plate 26 oriented towards the comb-level position of the draw-down element 11, 12, a bore 56 is provided, starting from the respective lateral limiting areas 57 of the upper recesses 47 and 51, into which has been inserted a compression spring 58, supported at the one end by the upper sliding block 43 and the projecting end 36 and on the other end by an adjusting screw 59 which is contained in a top hole 61 joined to the bore 56 containing the compression spring and being accessible from the upper end of the top plate 26. It should be understood that instead of the one compressions spring 58 two parallel compression springs could be provided which press on the sliding block 43, are contained in two parallel bores 56 and abut with their other ends on two parallel adjusting screws 59 in tap holes 61. The end of the top plate 26 away from this other end and oriented towards the draw-down position of the draw-down element 11, 12, is provided with a tap hole 62 starting at the respective end face, into which an adjusting screw 63 is inserted, the end of which an extend into the lower recesses 48 and 52. In this manner a stop face 64 of the lower sliding block 44 and of the abutting projecting end 37 is pressed against the adjusting screw 63 by means of the compression spring(s) 58, which press on the upper sliding block 43. With the aid of the visible adjusting screw 63 the relative position of the bottom plate 27 to the top plate 26 can be thus changed and the so-called alignment of the bottom plate 27 thereby adjusted. With the adjusting screw 59 (or with the two adjusting screws) the biasing spring pressure of the compression spring 58 (or the two compression springs) can be set.

The action of the draw-down element 11, 12 is as follows: If the draw-down element 11 is placed downwardly, via the link plate interlockingly connected with it, from the comb-level according to FIG. 1 into a draw-down position shown by dash-dotted lines in partial FIG. 1A, the bottom plate 27, along the draw-down track 21 of which the needles move, can since the drive acts on the top plate 26, follow elastically resiliently because of the storing action of the compression spring 58. At the end of the movement into the respective draw-down position, the original relative position of the top and bottom plates 26, 27, shown in FIGS. 1 and 2, is again resumed because of the preset force of the compression spring 58.

Figure 3:
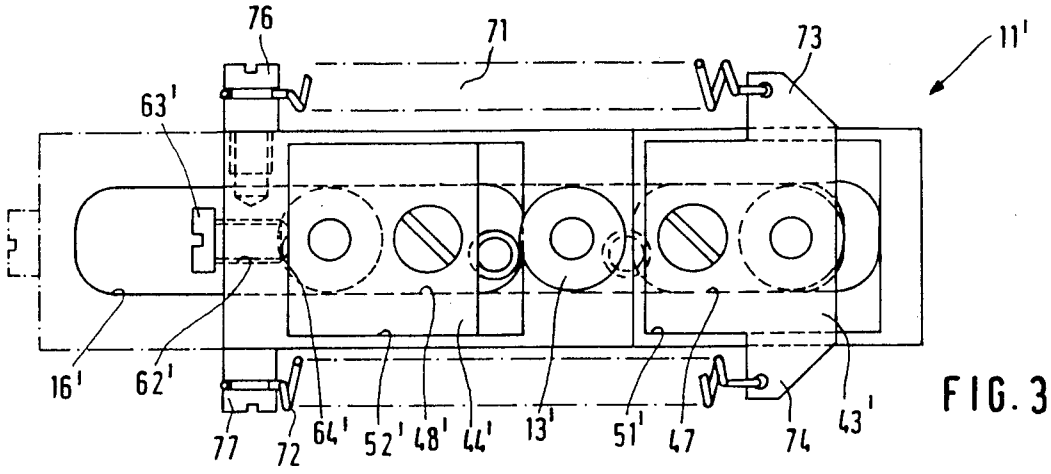
FIG. 3 is a top plan view similar to that of partial FIG. 1A, however, according to a second exemplary embodiment of the present invention.

The exemplary embodiment of a draw-down element 11' shown in FIG. 3 differs from the draw-down element 11 of FIGS. 1 and 2 only in that instead of compression springs(s) 58 and associated adjusting screw(s) 59 two exterior parallel tension springs 71 and 72 are provided, which act with their one end on a projection 73 or 74, and which are fixed on both sides on an upper sliding block 43' and above the surface of the top plate 26 extend beyond its sides. The respective other end of the tension springs 71, 72 act on a screw 76, 77, laterally screwed into the lower end of the top plate 26. To change the spring force of tension draw springs 71, 72 their end can, for example, act eccentrically on the screw 76, 77. Because of the lateral displacement of the springs in the form of draw springs 71, 72 the upper end of the top plate 26 can be shortened. The further elements of this draw-down element 11' correspond to those of the draw-down element 11 or 12, so that they have been drawn in FIG. 3 using the same reference numerals, but with a prime added. It is to be understood that there is a complimentary draw-down element 11' corresponding to the draw-down element 12.

Figure 4:
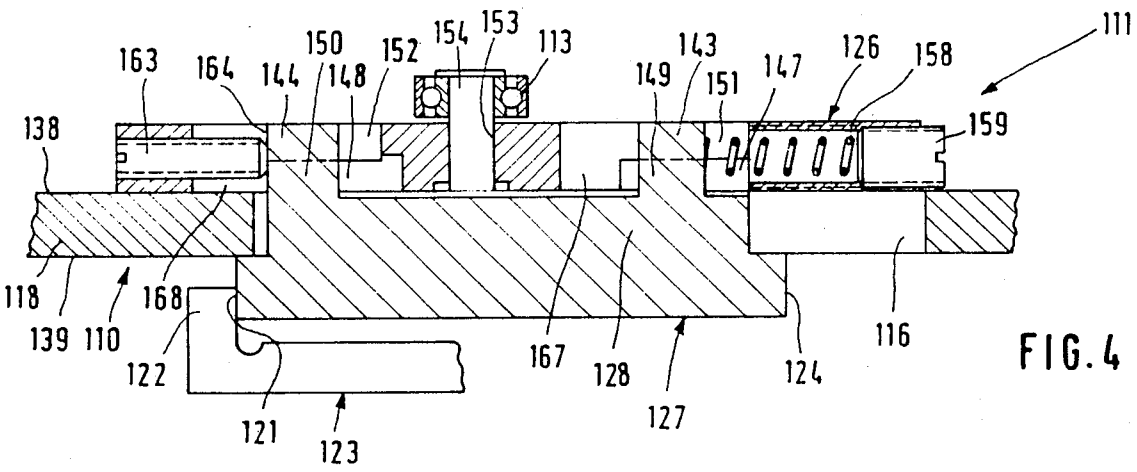
FIG. 4 is a section similar to that of FIG. 2, however in a draw-down position and in accordance with a third exemplary embodiment of the present invention.

The draw-down element 111 shown in FIG. 4 corresponds in its basic construction to the draw-down element 11 of FIGS. 1 and 2 and the draw-down element 11' of the FIG. 3, i.e., it has a top plate 126 provided with a link roller 113 and a bottom plate 127 movable relative thereto. The essential difference in this draw-down element 111 consist in the structure of the bottom plate 127, which has needle tracks 121 and 124. This bottom plate 127 and with its guide strip 128 and its sliding blocks 143 and 144, including connecting strips 149 and 160 provided between them and the guide strip 128, is formed in one piece. The guide strip 128, provided with sliding blocks 143 and 144, has an approximately U-shaped profile. For mounting of the bottom plate 127, which is one piece together with the guide strip 128 and the sliding blocks 143 and 144, on the top plate 126 the inner recesses 147 and 148 of the top plate 126 are enlarged at their end oriented towards the adjusting screw 163 to form insertion openings 167 or 168, which therefore have a width corresponding to the outer recess 151 or 152. Therefore the sliding blocks 143 and 144 can be inserted through these insertion openings 167 and 168 into the outer recesses 151 and 152. Correspondingly, the top plate 126 is provided with a compression spring 158 and an adjusting screw 159. To maintain the sliding blocks 143 and 144 within the outer recess 151 and 152 in the top plate 126 the adjusting screw 163 has such a length that it always extends beyond the length of the insertion opening 168. This means that the adjusting screw 163 can only be inserted after the joining of the bottom plate 127 and the top plate 126. Further elements of this draw-down element 11 which correspond to the elements of the draw-down element 11 of FIGS. 1 and 2, have therefore been provided with a reference numeral corresponding to FIG. 2, but raised by 100. It is to be understood that a complementary draw-down element corresponding to draw-down element 112 is associated with this draw-down element 111.

It is further to be understood that the above described exemplary embodiments of the invention have been given by way of example only and that further variants and improvements are possible within the scope of the invention.

What is claimed is:

1. A cam carriage for flat-bed knitting machines having at least one leading and trailing draw-down element with atop plate rigidly connected with a drive element at least in a direction of several draw-down positions, a bottom plate including a draw-down track, and a cam plate including a guide slot for guiding the draw-down element in a reciprocal manner between an alignment position, wherein the top plate and the bottom plate are movable relative to each other in their longitudinal direction, and are biased to assume a basic position such that a relative movement of the top plate and the bottom plate can occur only during a shifting movement of the top plate in the direction of one of the draw-down positions.

2. The cam carriage as defined in claim 1, further having at least one spring, and further wherein the top plate includes a stop, and the bottom plate is biased against said stop by said spring.

3. The cam carriage as defined in claim 2, further wherein said spring is a compression spring.

4. The cam carriage as defined in claim 3, further having an adjusting screw, and further wherein the top plate has a bore within which one end of the compression spring is received, the other end of said compression spring abutting said adjusting screw.

5. The cam carriage as defined in claim 3, further wherein the pre-stressing of the compression spring can be selected.

6. The cam carriage as defined in claim 5, further having an adjusting screw, and further wherein the top plate has a bore within which one end of the compression spring is received, the other end of said compression spring abutting said adjusting screw.

7. The cam carriage as defined in claim 2, further wherein said spring is a tension spring.

8. The cam carriage as defined in claim 7, further wherein the pre-stressing, of the tension spring can be selected.

9. The cam carriage as defined in claim 2, further wherein said stop is adjustable in the longitudinal direction of the draw-down element.

10. The cam carriage as defined in claim 9, further wherein said stop is formed as a threaded element which can be screwed into the top plate in its longitudinal direction and locked.

11. The cam carriage as defined in claim 1, further having a spring and a stop, and further wherein the bottom plate is provided with preferably two guide blocks, and the top plate with recesses containing said guide blocks, said spring acting on one of said guide blocks while the other guide block abuts said stop in the basic position.

12. The cam carriage as defined in claim 11, further having a guide strip and an insertion opening, and further wherein the bottom plate, the guide blocks and the guide strip are formed as one piece with the recesses in said top plate being connected with the insertion opening.

13. The cam carriage as defined in claim 11, further having a guide strip, and further wherein the guide blocks are connected with the bottom plate via the guide strip by means of which the draw-down element is movably guided in the guide slot of the cam plate.

14. The cam carriage as defined in claim 13, further having an insertion opening, and further wherein the bottom plate, the guide blocks and the guide strip are formed as one piece with the recesses in said top plate being connected with the insertion opening.

15. The cam carriage as defined in claim 13, further having at least two screws, and further wherein the guide blocks, the guide strip and the bottom plate are fastened together by said screws.

* * * * *